United States Patent [19]

Augros

[11] 4,093,096

[45] June 6, 1978

[54] REMOVABLE STOPPER FOR A SCREW-NECK BOTTLE

[75] Inventor: Jacques Julien Augros, Villiers le Bel, France

[73] Assignee: Societe Anonyme dite: Arts et Techniques Nouvelles, France

[21] Appl. No.: 798,455

[22] Filed: May 19, 1977

[51] Int. Cl.[2] ..... B65D 41/04

[52] U.S. Cl. ..... 215/330; 215/331; 215/334

[58] Field of Search ..... 215/330, 331, 334, 216; 220/288

[56] References Cited

U.S. PATENT DOCUMENTS

| | | | |
|---|---|---|---|
| 1,612,449 | 12/1926 | Lee | 215/331 |
| 2,423,582 | 7/1947 | Coleman | 215/330 X |
| 2,684,168 | 7/1954 | McGinnis | 215/330 |
| 2,744,647 | 5/1956 | Wheaton | 215/334 |
| 3,182,840 | 5/1965 | Polzin | 215/216 |
| 3,612,323 | 10/1971 | Malick | 215/216 X |
| 3,685,678 | 8/1972 | Ritzenhoff | 220/288 X |
| 3,805,987 | 4/1974 | Horvath | 215/330 X |
| 3,888,376 | 6/1975 | Cooke | 215/216 X |

*Primary Examiner*—Donald F. Norton

*Attorney, Agent, or Firm*—Weingarten, Maxham & Schurgin

[57] ABSTRACT

A removable stopper for a screw-neck bottle. The bottle has a radial projection arranged transverse to the thread forming a stop at the lower end of the thread. The stopper has a mating internal thread also having a terminal transverse radial projection at the lower end thereof. A second transverse radial projection spaced from and parallel to the terminating projection is formed on the stopper inner wall. The second projection resides on a weakened portion of the stopper wall to permit it to flex radially and pass over the transverse projection on the bottle neck when either applied to or removed from the bottle. The bottle neck projection is closely confined between the two projections on the stopper when in engaged position.

4 Claims, 3 Drawing Figures

REMOVABLE STOPPER FOR A SCREW-NECK BOTTLE

BACKGROUND OF THE INVENTION

The present invention relates to screw stoppers in which the screw thread of the bottle neck terminates in a transverse projection forming a positioning stop for a corresponding projection of the screw thread of the stopper, which also comprises a second projection locked behind the stop of the neck. The passage of this second projection over the stop shoulder of the neck requires a certain elasticity of the stopper, failing which said second projection is rapidly destroyed. For decorative purposes, the prior art stoppers are made of plastic material coated with a metal cap which renders the stoppers undeformable. This results in the use of the stopper device described hereinabove being impossible.

It is an object of the invention to remedy this drawback both for stoppers covered with a rigid cap and for those whose plastic walls are too thick to obtain sufficient elasticity.

SUMMARY OF THE INVENTION

The invention therefore relates to a removable stopper for a screwnecked bottle which comprises, at the end of the thread, a transverse stop shoulder, said stopper comprising a transverse projection at the end of the screw thread and a second, spaced-apart projection, parallel to the first, these two projections closely confining between them the stop shoulder of the bottle neck, said stopper being characterised in that the zone of the skirt of the stopper which bears the second projection is weakened. The stopper may be removed and replaced on the bottle neck without damage.

DESCRIPTION OF THE PREFERRED EMBODIMENT

Figure 1:
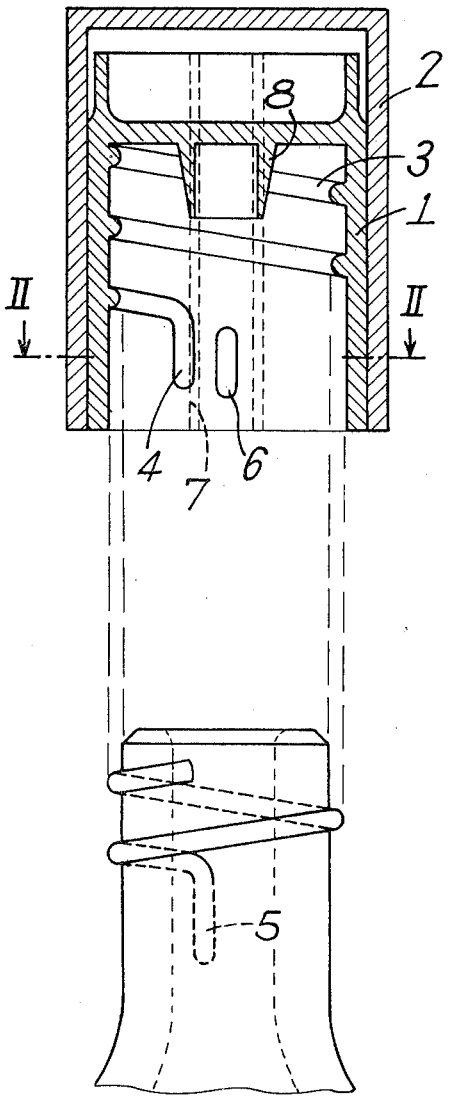
FIG. 1 is a section through the stopper according to the invention with the bottle neck on which it is to be screwed.
Figure 2:
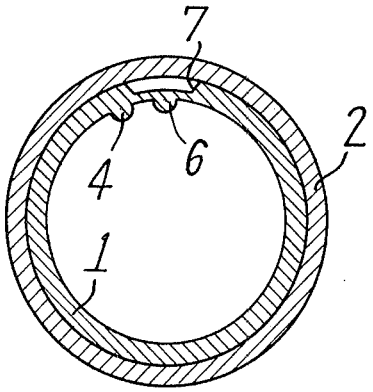
FIG. 2 is a section along II—II of FIG. 1.

The stopper shown in FIGS. 1 and 2 is formed by a screw-on stopper 1 made of plastic material covered with a rigid, for example, metallic cap 2.

The screw thread 3 of the stopper 1 terminates in a transverse radial projection 4 which abuts against a corresponding radial stop 5 on the bottle neck which receives this stopper.

A second radial projection 6 on the stopper is disposed parallel to and spaced from projection 4 and when the stopper is screwed on the bottle, said second projection 6 locks behind the stop 5, which is thus closely confined between the two projections 4 and 6 of the stopper.

To allow the projection 6 to pass over stop 5, material is removed from the outer surface of the stopper, forming a notch 7 as it appears in FIG. 2. The position of this notch corresponds to the location of the projection 6 on the inner surface of the stopper.

This notch thus gives elasticity to the zone of the stopper which surrounds the projection 6 and enables this projection to yield when passing over the stop 5 on the neck of the bottle. This stopper may thus be removed from and screwed onto the bottle neck any number of times without damage.

In the stopper device shown, the stopper 1 comprises a cone 8 which engages in the neck where it is wedged, thus hermetically closing said neck.

In this type of stopper, the screw pitch enables the cone to be easily unwedged, which is more difficult in the case of a nonthreaded stopper.

Figure 3:
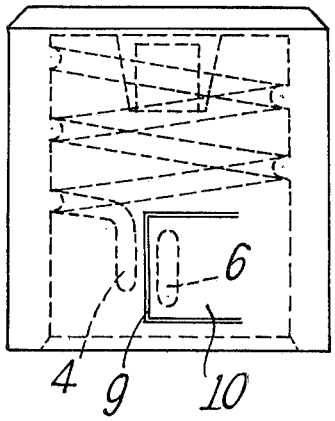
FIG. 3 is a variant of the stopper of FIG. 1.

In the case of a stopper 1 without the cap shown in FIG. 1, but with an otherwise thick and undeformable skirt, a notch would be unaesthetic. Thus, to render elastic the zone which includes the projection 6, a cut-out 9, as shown in FIG. 3, is made around said projection which determines in the skirt of the stopper a tongue 10 bearing the projection 6, said tongue rising elastically when projection 6 passes over stop 5.

What is claimed is:

1. A removable stopper for a screw-neck bottle wherein the bottle neck is formed with a radial projection arranged transverse to the thread at the lower end of the external surface thereof, said stopper comprising:

a generally cylindrical closure having a closed upper end and a lower open skirt portion, the internal surface of said skirt being formed with a thread configured to mate with the thread on the bottle neck;

a first radial projection at the lower end of said internal thread and arranged transverse thereto; and a second radial projection parallel to and spaced from said first projection, said second projection being surrounded by a zone of the material of said skirt, said zone bearing said second projection being weakened whereby when said bottle neck is engaged by said stopper, said weakened zone flexes to permit said second projection to move radially upon abutting the projection on said bottle neck to pass thereover when moving in either direction, said first and second projections being arranged and configured to closely confine the projection on said bottle neck.

2. The stopper as recited in claim 1, wherein the weakened zone of the skirt is obtained by thinning down this zone.

3. The stopper as recited in claim 1, wherein the weakened zone of the skirt is obtained by a notch in the outer face of the skirt.

4. The stopper as recited in claim 1, wherein the weakened zone of the skirt is obtained by a cut-out partially around the zone of the skirt, which determines an elastic tongue bearing the second projection.

* * * * *